US007444890B2

(12) United States Patent
Czernecki et al.

(10) Patent No.: US 7,444,890 B2
(45) Date of Patent: Nov. 4, 2008

(54) PIPETTING DEVICE

(75) Inventors: Andrzej Czernecki, Warsaw (PL); Wojciech Wyszogrodzki, Warsaw (PL); Andrzej Jankowski, Warsaw (PL); Piotr Urban, Warsaw (PL)

(73) Assignee: PZ HTL Spolka Akcyjna, Warsaw (PL)

( * ) Notice: Subject to any disclaimer, the term of this patent is extended or adjusted under 35 U.S.C. 154(b) by 405 days.

(21) Appl. No.: 10/544,386

(22) PCT Filed: Apr. 8, 2003

(86) PCT No.: PCT/PL03/00036

§ 371 (c)(1),
(2), (4) Date: Jan. 17, 2006

(87) PCT Pub. No.: WO2004/071664

PCT Pub. Date: Aug. 26, 2004

(65) Prior Publication Data

US 2006/0144168 A1 Jul. 6, 2006

(30) Foreign Application Priority Data

Feb. 11, 2003 (PL) ..... 358680

(51) Int. Cl.
*B01L 3/02* (2006.01)

(52) U.S. Cl. ..... 73/864.14

(58) Field of Classification Search ..... 73/864.14, 73/864.11, 864.18; 422/925, 928, 931–932
See application file for complete search history.

(56) References Cited

U.S. PATENT DOCUMENTS

| | | | | | |
|---|---|---|---|---|---|
| 3,766,785 | A * | 10/1973 | Smernoff | ..... | 73/864.14 |
| 3,963,061 | A | 6/1976 | Kenney | ..... | 222/373 X |
| 4,624,147 | A | 11/1986 | Kenney | ..... | 73/864.15 |
| 6,240,791 | B1 | 6/2001 | Kenney | ..... | 73/864.14 |
| 6,253,628 | B1 | 7/2001 | Steele et al. | ..... | 73/864.15 |
| 6,982,063 | B2 * | 1/2006 | Hamel et al. | ..... | 422/100 |

FOREIGN PATENT DOCUMENTS

| | | | | | |
|---|---|---|---|---|---|
| DE | 38 18 704 | A1 | 7/1989 | | |
| JP | 62134536 | A * | 6/1987 | ..... | 73/864.18 |
| WO | WO 2004/071664 | A1 | 8/2004 | | |

OTHER PUBLICATIONS

English Language Abstract of EP Equivalent (0344792) for DE 38 18 704.

* cited by examiner

*Primary Examiner*—Thomas P Noland
(74) *Attorney, Agent, or Firm*—Michael Bednarek; Paul, Hastings, Janofsky & Walker LLP

(57) ABSTRACT

A pipetting device comprises a housing (1) with a handle (2) and a pipette (4) holder assembly (3), wherein the housing (1) end portion (7) incorporates a spherical raceway (16) to which the pipette (4) holding assembly (3) in mounted by the means of a connecting assembly (17) capable of sliding on the spherical raceway (16) at the housing (1) end portion (7) to facilitate the change of orientation angle of the pipette (4) axle in every plane with respect to the handle (2). The connecting assembly (17) comprises a first slider (18) slidably set in a rectangular opening (19) in the spherical raceway (16) at the housing (1) end portion (7), and a second slider (20) slidably set in a rectangular opening (21) in the first slider (18).

11 Claims, 2 Drawing Sheets

PIPETTING DEVICE

BACKGROUND OF THE INVENTION

1. Field of the Invention

This invention relates to a pipetting device for aspirating liquid into a pipette and dispensing liquid from the pipette.

2. Description of the Related Art

There are known pipetting devices, e. g. from the German patent publication No. 3818704 or U.S. Pat. Nos. 3,963,061, 4,624,147 and 6,240,791, for aspirating liquid into a pipette and dispensing liquid from the pipette. Such pipetting devices comprise a housing, usually with rectangular cross-section, consisting of one part being the handle, and the other sleeve-shaped part, to which the pipette holder assembly is mounted generally perpendicularly. Moreover the device comprises a liquid aspiration button and a liquid dispensing button, both mounted in the handle.

SUMMARY OF THE INVENTION

According to the present invention, the pipetting device for aspirating liquid into a pipette and dispensing liquid from the pipette, comprises a housing and a handle, whereas the end portion of the housing comprises a cylindrical raceway, to which the pipette holder assembly is mounted by the means of a connecting assembly capable of sliding on the cylindrical raceway at the housing end portion for the sake of changing the orientation angle of the pipette axis in one plane with respect to the handle.

Preferably the connecting assembly comprises a slider slidably set in the rectangular opening in the cylindrical raceway at the end portion of the housing.

Preferably the slider comprises a connecting member connected to the pipette holder assembly and to the air tubing.

Preferably the cap of the holder assembly is pressed to the cylindrical raceway at the housing end portion in a fixed position of the pipette with respect to the handle.

According to a variety of the present invention, the pipetting device for aspirating liquid into a pipette and dispensing liquid from the pipette, comprises a housing and a handle, whereas the end portion at the housing comprises a spherical raceway, to which the pipette holder assembly is mounted by the means of a connecting assembly capable of sliding on the spherical raceway of the housing end portion for the sake of changing the orientation angle of the pipette axis in every plane with respect to the handle.

Preferably the connecting assembly comprises the first slider slidably set in the rectangular opening in the spherical raceway at the housing end portion.

Preferably the connecting assembly comprises the second slider slidably set in the rectangular opening of the first slider.

Preferably the main axis of the rectangular opening in the first slider is perpendicular to the main axis of the rectangular opening in the spherical raceway at the end portion of the housing.

Preferably the second slider comprises a connecting member connected to the pipette holder assembly and to the air tubing.

Preferably the cap of the holder assembly is pressed to the spherical raceway at the housing end portion in a fixed position of the pipette with respect to the handle.

The solution according to the invention provides changeability of orientation angle of the axis of a pipette mounted to the pipette holder assembly in one plane or in every plane with respect to the handle.

BRIEF DESCRIPTION OF THE DRAWINGS

The accompanying drawings, which are incorporated in, and form a part of the specification, illustrate embodiments of the present invention and, together with the description, serve to explain the principles of the invention. In the drawings.

Figure 1:
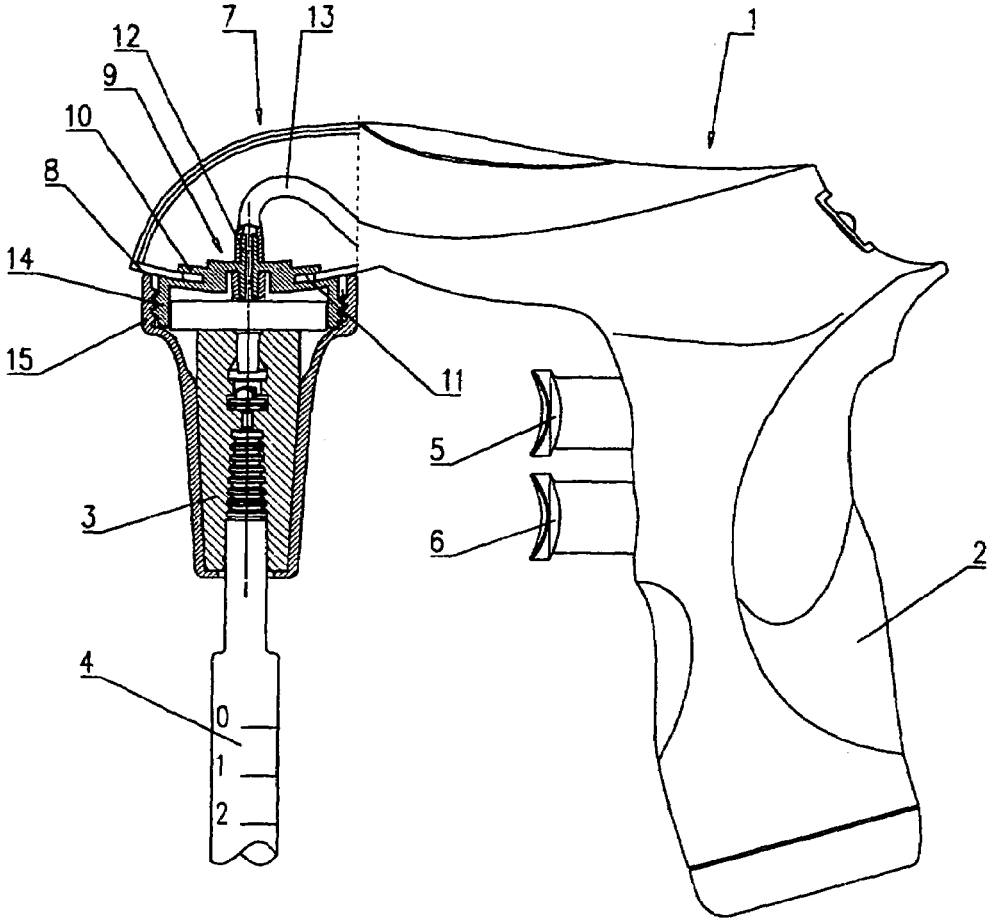
FIG. 1 shows in partial section the pipetting device with cylindrical raceway.

while elements common for the devices depicted on the drawing have the same numerical designation.

DETAILED DESCRIPTION OF THE INVENTION

Reference will now be made in detail to the preferred embodiments of the invention, examples of which are illustrated in the accompanying drawings.

Figure 2:
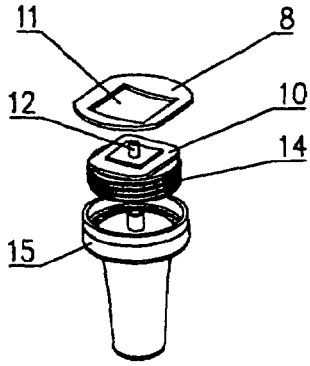
FIG. 2 shows the connecting assembly of the device from the FIG. 1.

The pipetting device shown in the FIG. 1 and FIG. 2 comprises a housing (1) with a handle (2), and a holder assembly (3) for a pipette (4). The handle (2) has liquid aspiration button (5), and liquid dispensing button (6), which control the flow of air to the pipette (4). In turn, the housing (1) end portion (7) comprises cylindrical raceway (8) which surface is a sector of a cylindrical surface. The pipette (4) holder assembly (3) is mounted to the cylindrical raceway (8) by the means of the connecting assembly (9) capable of sliding on the cylindrical raceway (8) of the housing (1) end portion (7) for the sake of changing the orientation angle of the pipette (4) axis in one plane with respect to the handle (2). In order to accomplish this, the connecting assembly (9) has a slider (10) slidably mounted in a rectangular opening (1) in the cylindrical raceway (8) of the housing (1) end portion (7), whereas the shape of the slider (10) preferably matches the surface of the cylindrical raceway (8), while the main axis of the rectangular opening (11) in the cylindrical raceway (8), on which the slider (10) slides, preferably lies in the same plane as the axis of the pipette (4) and the axis of the handle (2). Moreover the connecting assembly (9) includes a connecting member (12) positioned centrally in the slider (10), and connected to the pipette (4) holder assembly (3), and to an air tubing (13), and the connecting assembly (9) comprises, at its end proximal to the holder assembly (3), a cylindrical portion (14) with male thread. The pipette (4) holder assembly (3) is mounted to the cylindrical raceway (8) of the housing (1) end portion (7) by the means of a cap (15) with female thread which is screwed upon the cylindrical portion (14) of the connecting assembly (9). In fixed position of the pipette (4) with respect to the handle (2), the cap (15) of the holder assembly (3), after thread tightening, is pressed to the cylindrical raceway (8) of the housing (1) end portion (7).

Figure 3:
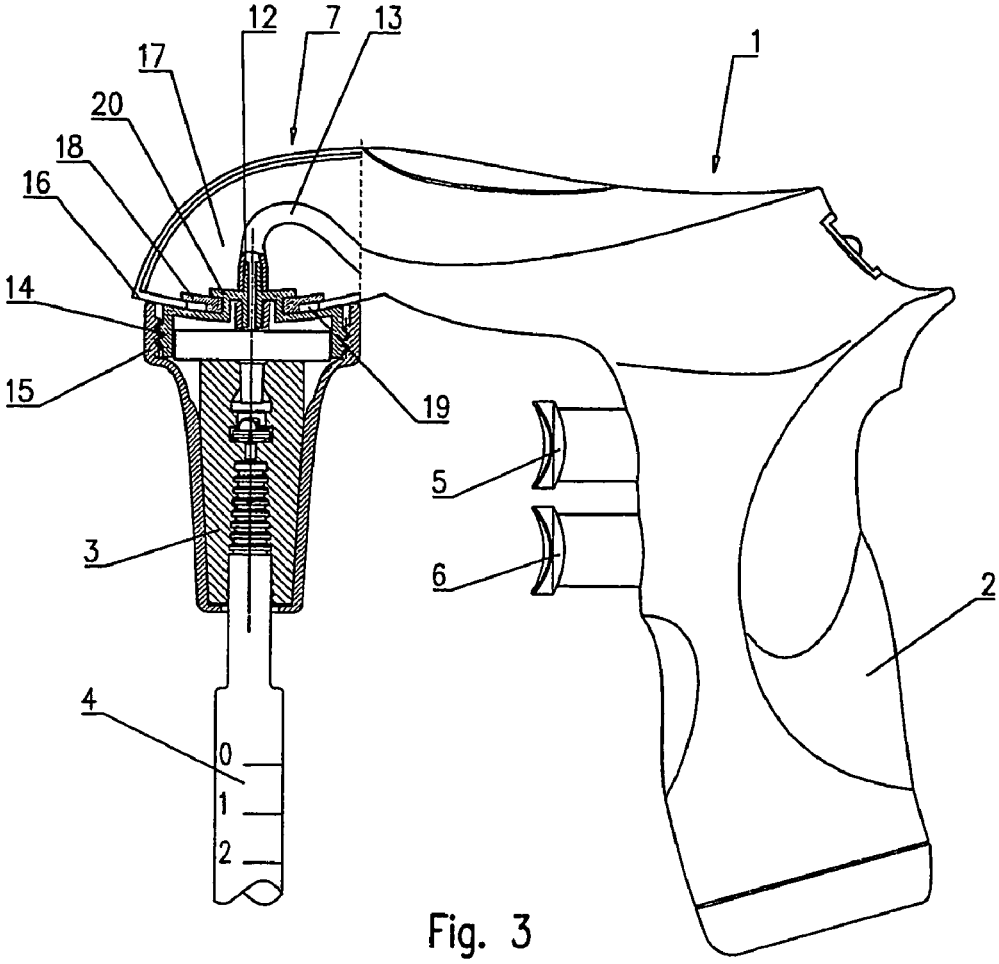
FIG. 3 shows partial section of the pipetting device with spherical raceway.
Figure 4:
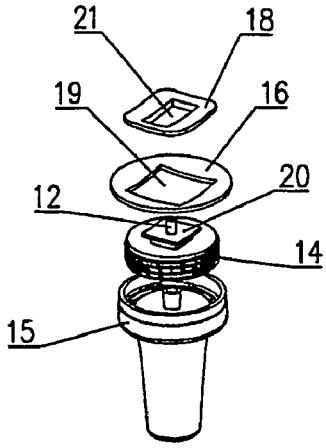
FIG. 4 shows the connecting assembly of the device from the FIG. 3.

In a variety of the embodiment of the pipetting device according to the invention illustrated in the FIG. 3 and FIG. 4 the end portion (7) of the housing (1) has a spherical raceway (16) which surface is a sector of a spherical surface. The pipette (4) holder assembly (3) is mounted to the spherical raceway (16) by the means of a connecting assembly (17) improved in comparison to the connecting assembly (9) from pipetting device shown in FIG. 1 and FIG. 2, which is capable of sliding on the spherical raceway (16) of the housing (1) end portion (7) for the sake of changing the orientation angle of the pipette (4) axis in all planes with respect to the handle (2).

For this purpose, the connecting assembly (17) includes a first slider (18) slidably set in a rectangular opening (19) in the spherical raceway (16) of the housing (1) end portion (7), whereas the shape of the first slider (18) preferably matches the spherical raceway (16) of the housing (1) end portion (7), and includes a second slider (20) slidably set in a rectangular opening (21) in the first slider (18), whereas the shape of the second slider (20) preferably matches the rectangular opening (21) in the first slider (18). Preferably the main axis of the rectangular opening (21) in the first slider (18), on which the second slider (20) slides, is perpendicular to the main axis of the rectangular opening (19) in the spherical raceway (16), on which the first slider (18) slides. Moreover the connecting assembly (17) comprises centrally positioned in the second slider (20) the connecting member (12) connected to the pipette (4) holder assembly (3), and to the air tubing (13), and the connecting assembly (17) includes, at the end proximal to the holder assembly (3), the cylindrical part (14) with male thread. The pipette (4) holder assembly (3) is mounted to the spherical raceway (16) of the housing (1) end portion (7) by the cap (15) with female thread which is screwed upon the cylindrical portion (14) of the connecting assembly (9). In fixed position of the pipette (4) with respect to the handle (2), the cap (15) of the holder assembly (3), after thread tightening, is pressed to the spherical raceway (16) of the housing (1) end portion (7).

Basing on the above examples of the invention embodiments it is possible to make various changes, modifications and improvements remaining within the scope of this invention, whereas such changes, modifications and improvements are obvious in the light of the disclosed essence of the invention and enclosed claims.

We claim:

1. A pipetting device for aspirating liquid into a pipette and dispensing liquid from the pipette, comprising a housing and a handle, wherein an end portion of the housing comprises a raceway to which a pipette holder assembly is mounted by means of a connecting assembly capable of sliding on the raceway at the housing end portion for the sake of changing the orientation angle of the pipette axis in at least one plane with respect to the handle.

2. The pipetting device of claim 1, wherein the raceway comprises a cylindrical raceway for the sake of changing the orientation angle of the pipette axis in one plane with respect to the handle.

3. The device of claim 2, wherein the connecting assembly comprises a slider slidably set in a rectangular opening in the cylindrical raceway at the end portion of the housing.

4. The device of claim 3, wherein the slider comprises a connecting member connected to the pipette holder assembly, and to an air tubing.

5. The device of claim 1, wherein a cap of the holder assembly is pressed to the cylindrical raceway at the housing end portion in a fixed position of the pipette with respect to the handle.

6. The pipetting device of claim 1, wherein the raceway comprises a spherical raceway for the sake of changing the orientation angle of the pipette axis in every plane with respect to the handle.

7. The device of claim 6, wherein the connecting assembly comprises a first slider slidably set in a rectangular opening in the spherical raceway at the housing end portion.

8. The device of claim 7, wherein the connecting assembly comprises a second slider slidably set in a rectangular opening of the first slider.

9. The device of claim 8, wherein the second slider comprises the connecting member connected to the pipette holder assembly, and to an air tubing.

10. The device of claim 8, wherein the main axis of the rectangular opening in the first slider is perpendicular to a main axis of the rectangular opening in the spherical raceway at the end portion of the housing.

11. The device of claim 6, wherein a cap of the holder assembly is pressed to the spherical raceway at the housing end portion in a fixed position of the pipette with respect to the handle.

* * * * *

UNITED STATES PATENT AND TRADEMARK OFFICE

CERTIFICATE OF CORRECTION

PATENT NO. : 7,444,890 B2
APPLICATION NO. : 10/544386
DATED : November 4, 2008
INVENTOR(S) : Andrzej Czernecki et al.

It is certified that error appears in the above-identified patent and that said Letters Patent is hereby corrected as shown below:

Col. 4, Claim 5 should read as follows.

5. The device of claim 2, wherein a cap of the holder assembly is pressed to the cylindrical raceway at the nhousing end portion in a fixed position of the pipette with respect to the handle.

Signed and Sealed this

Twenty-seventh Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,444,890 B2
APPLICATION NO. : 10/544386
DATED : November 4, 2008
INVENTOR(S) : Andrzej Czernecki et al.

It is certified that error appears in the above-identified patent and that said Letters Patent is hereby corrected as shown below:

Col. 4, lines 14-17, Claim 5 should read as follows.

5. The device of claim 2, wherein a cap of the holder assembly is pressed to the cylindrical raceway at the housing end portion in a fixed position of the pipette with respect to the handle.

This certificate supersedes the Certificate of Correction issued July 27, 2010.

Signed and Sealed this

Twenty-fourth Day of August, 2010

David J. Kappos

David J. Kappos
*Director of the United States Patent and Trademark Office*